US010667056B2

(12) United States Patent
O'Connor et al.

(10) Patent No.: US 10,667,056 B2
(45) Date of Patent: May 26, 2020

(54) LOW POWER SYNCHRONOUS DATA INTERFACE

(71) Applicant: Avnera Corporation, Beaverton, OR (US)

(72) Inventors: Chris O'Connor, Beaverton, OR (US); Xudong Zhao, Portland, OR (US)

(73) Assignee: AVNERA CORPORATION, Hillsboro, OR (US)

( * ) Notice: Subject to any disclaimer, the term of this patent is extended or adjusted under 35 U.S.C. 154(b) by 0 days.

(21) Appl. No.: 15/599,331

(22) Filed: May 18, 2017

(65) Prior Publication Data

US 2017/0257702 A1 Sep. 7, 2017

Related U.S. Application Data

(63) Continuation of application No. 14/320,104, filed on Jun. 30, 2014, now Pat. No. 9,686,609.

(60) Provisional application No. 61/840,929, filed on Jun. 28, 2013.

(51) Int. Cl.

| | |
|---|---|
| ***H04R 3/12*** | (2006.01) |
| ***H04R 1/10*** | (2006.01) |
| ***H04R 29/00*** | (2006.01) |
| *H04R 5/04* | (2006.01) |
| *G10L 19/012* | (2013.01) |

(52) U.S. Cl.

CPC ..... *H04R 3/12* (2013.01); *H04R 1/1041* (2013.01); *H04R 29/001* (2013.01); *G10L 19/012* (2013.01); *H04R 5/04* (2013.01); *H04R 2420/05* (2013.01); *H04R 2460/03* (2013.01)

(58) Field of Classification Search

CPC ..... H04R 1/1041; H04R 2420/05; H04R 2460/03; H04R 29/001; H04R 5/04; G10L 19/012

See application file for complete search history.

(56) References Cited

U.S. PATENT DOCUMENTS

| | | | | |
|---|---|---|---|---|
| 5,706,396 | A * | 1/1998 | Schroder | H04B 1/667 704/216 |
| 6,721,337 | B1 | 4/2004 | Kroeger et al. | |
| 8,456,517 | B2 * | 6/2013 | Spektor | G06K 9/00355 348/43 |
| 2003/0161479 | A1 * | 8/2003 | Yang | H04S 3/02 381/22 |
| 2007/0025738 | A1 * | 2/2007 | Moore | H04B 10/1149 398/189 |
| 2008/0002580 | A1 | 1/2008 | Kawada et al. | |
| 2008/0170564 | A1 | 7/2008 | Shi et al. | |

(Continued)

*Primary Examiner* — Regina N Holder

(74) *Attorney, Agent, or Firm* — Lando & Anastasi, LLP

(57) ABSTRACT

A low power, digital audio interface includes support for variable length coding depending on content of the audio data sent from the interface. A particularized coding system is implemented that uses techniques of silence detection, dynamic scaling, and periodic encoding to reduce sent data to a minimum. Other techniques include variable packet scaling based on an audio sample rate. Differential signaling techniques are also used. The digital audio interface may be used in a headphone interface to drive digital headphones. A detector in the interface may detect whether digital or analog headphones are coupled to a headphone jack and drive the headphone jack accordingly.

22 Claims, 13 Drawing Sheets

(56) References Cited

U.S. PATENT DOCUMENTS

| | | | | |
|---|---|---|---|---|
| 2009/0192804 | A1* | 7/2009 | Schuijers | G10L 19/008 704/500 |
| 2009/0278984 | A1 | 11/2009 | Suzuki et al. | |
| 2011/0224991 | A1* | 9/2011 | Fejzo | G10L 19/0017 704/500 |
| 2011/0300874 | A1 | 12/2011 | Chen | |
| 2012/0087503 | A1 | 4/2012 | Watson et al. | |
| 2013/0078930 | A1* | 3/2013 | Chen | H04M 1/03 455/74 |
| 2014/0073429 | A1 | 3/2014 | Meneses et al. | |

* cited by examiner

LOW POWER SYNCHRONOUS DATA INTERFACE

CROSS REFERENCE TO RELATED APPLICATIONS

The present application is a continuation U.S. Non-provisional patent application Ser. No. 14/320,104, filed Jun. 30, 2014 and entitled "LOW POWER SYNCHONOUS DATA INTERFACE," which claims benefit of U.S. Provisional Application Ser. No. 61/840,929, filed Jun. 28, 2013, and entitled LOW POWER SYNCHONOUS DATA INTERFACE, both of which are incorporated by reference herein.

FIELD OF THE INVENTION

This disclosure is directed to systems and methods for transmitting data across an interface, and, more particularly, to systems and methods for transmitting data, including audio data, across a synchronous interface that uses very low power.

BACKGROUND

A need has emerged in mobile devices for a powered, digital headphone capability to enable advanced signal processing functionality such as ANC (active noise cancellation), DSP (Digital Signal Processor) based EQ tuning, bi-directional interactivity with the mobile device, and possible inclusion of sensors for monitoring biometrics and the environment.

A popular conventional interface that provides power and digital connectivity in computers and electronic devices is the Universal Serial Bus (USB). The use of USB in mobile devices, however, has evolved to include 480 Mbps USB 2.0 or higher and advanced hub capability. Typically, the power consumption to support the full USB standard and the high speed interface is too high for the low power audio streaming modes that most mobile platforms support. Further, the USB is often turned off during low power operating modes, such as when only the headphones are used. Therefore, in order to support a powered, digital headphone capability, a new approach is needed.

Embodiments of the invention address these and other limitations of the prior art.

DETAILED DESCRIPTION

Embodiments of the invention are directed to a low power, digital audio and data interface that is suitable for operation in a mobile device while playing audio and connected to an external digital headphone. Further embodiments of the invention are operable while the mobile device is in a lowest power connected state while efficiently powering a device, such as the digital headphone, from the mobile device itself.

In this description the synchronous interface may be referred to as a low-power digital audio headphone interface ("LPDI"), as a synchronous data interface, as the interface 150, or simply as "the interface." Although some embodiments set forth below are described with reference to digital headphones for convenience of explanation, other data-using devices, data-providing devices, or combination data using and providing devices may be coupled to the interface. In other embodiments the interface may be used as a chip-to-chip, device-to-device, or element to element interface within an electrical device.

In some embodiments, the interface is suitable as a replacement for a USB connection carrying digital audio and general data. The interface consumes much lower current compared to a USB based solution. In addition, the interface enables a lightweight digital implementation that does not require the processor resources that USB requires, and therefore may be integrated as part of a smart analog audio CODEC (Coder-Decoder) in a mobile device or a digital logic IP core as part of the peripheral controller functionality in a mobile device chipset.

Figure 1:
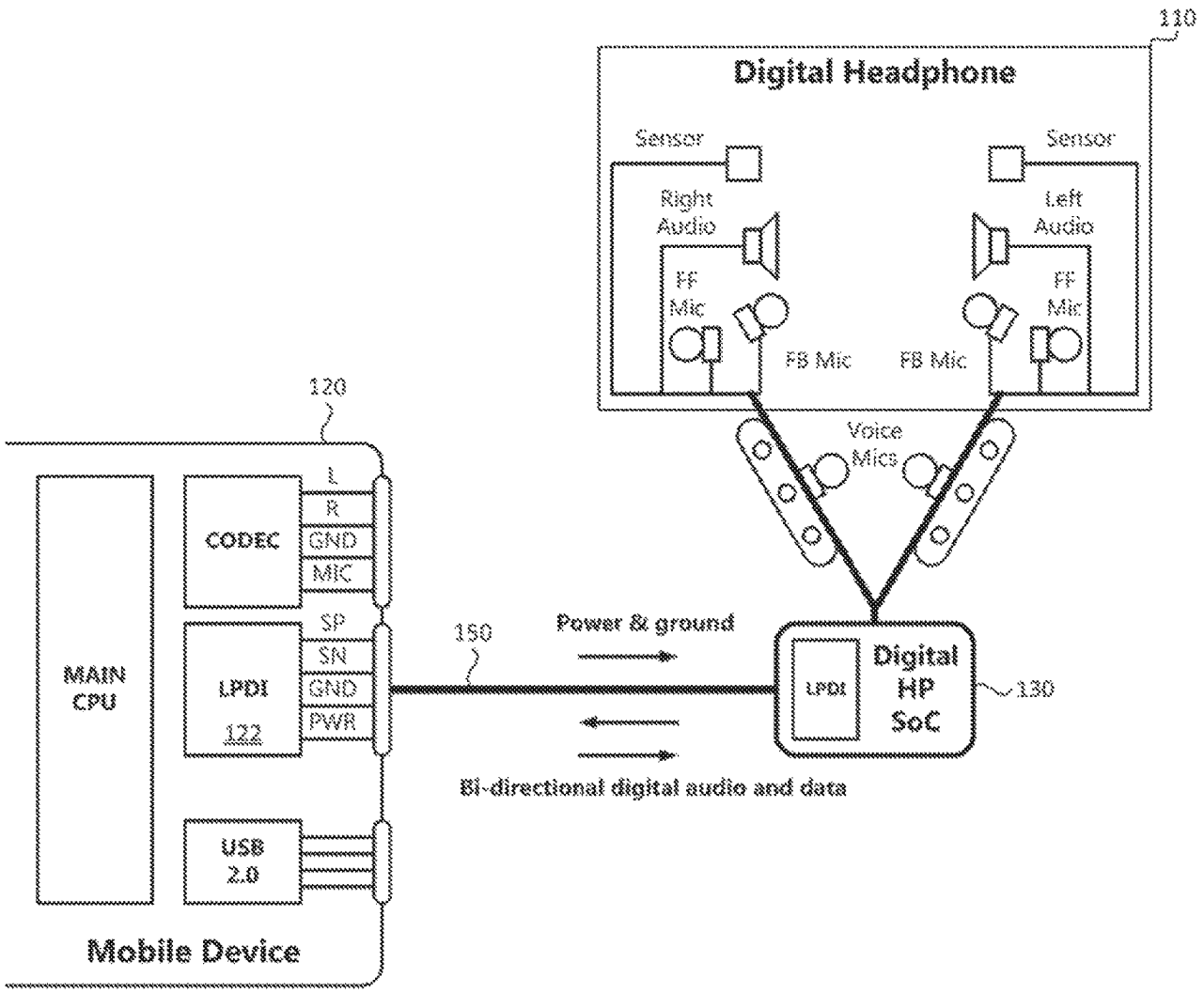
FIG. 1 is a functional block diagram of illustrating a set of digital headphones coupled to an audio device using a digital data interface according to embodiments of the invention.

FIG. 1 is a functional block diagram of digital headphones 110 coupled to an audio device 120 using a digital data interface 150 according to embodiments of the invention. In general, a low powered digital interface 122 provides power, ground, and audio data to a client 130 interface. As described below, the client interface 130 decodes the audio information and may use it to drive headphones, for example.

The described interface 150 is a minimum wire count interface from a mobile host device to an accessory such as a digital headphone accessory, or from one component to another in an electrical device. The interface 150 is typically embodied in a 4-wire interface, but may also be expressed in a 1 or 3 wire interface, as described in detail below. In general the LPDI system described herein is described with reference to a host device coupled to a client device, but other embodiments are also described.

The LPDI system provides both bi-directional digital audio and data from the host to the client and a regulated supply voltage output, such as 3.3V.

Figure 2:
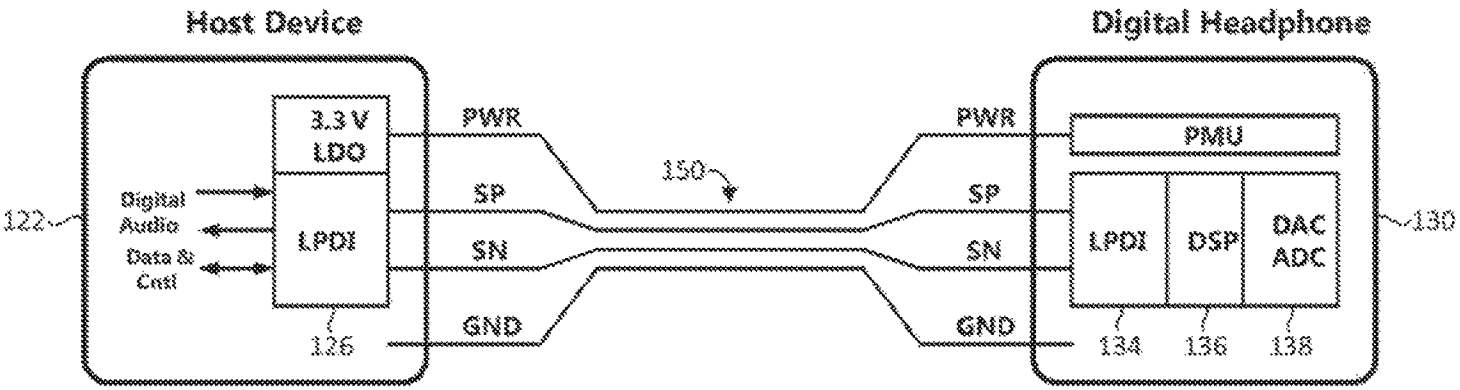
FIG. 2 is a simplified functional block diagram showing physical structure of the interface of FIG. 1.

FIG. 2 is a simplified functional block diagram showing an example physical structure of the interface 150 of FIG. 1. Particularly, FIG. 2. shows a basic host device 122 coupled to a client 130, for example a digital headphone interface 130. Particularly, the interface 150 of FIG. 2 illustrates a 4-wire version of the interface 150.

Figure 3:
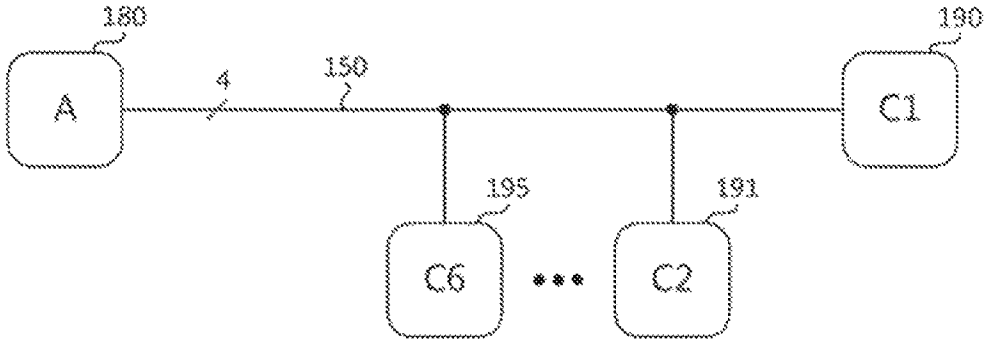
FIG. 3 is a simplified functional block diagram illustrating how the interface of FIG. 1 may be used with multiple clients.

Although the interface 150 enables a point-to-point connection from a host to a single client, the interface may also be extended to support a multi-drop network with multiple clients connected to one host. For instance, as illustrated in FIG. 3, a host 180 is coupled to, for example, up to six clients 190, 191, 195, etc. all through the same interface 150. In general, though, the primary usage of the interface 150 is well suited for a two client audio sharing usage case.

As illustrated in FIG. 2, the connection lines of the interface 150 include power (PWR), ground (GND), and data lines labeled SP and SN. The power may be a nominal voltage, such as 3.3 volts, as illustrated in the host device 122 of FIG. 2. Further, the ground reference is also provided from the host 122. In some embodiments the power is a regulated output voltage provided for external accessories, and may have a tolerance value of +/−10%. Further, devices or accessories coupled to the interface 150 may use the power on the PWR line up to a limit. For example, power load limits may have a maximum of 50-200 mA load, and more preferably a maximum load of approximately 100 mA.

An interface 126 within the host 122 drives the data lines SP and SN, while a corresponding interface 134 located in the client 130 receives the data from the SP and SN lines and decodes the data. A Digital Signal Processor (DSP) 136 processes the audio data and a converter 138, such as either a Digital to Analog Converter (DAC) or Analog to Digital Converter (ADC) provides the audio signal to the desired device.

The data lines SP and SN within the interface 150 work by using differential signaling techniques, for example by using a complimentary swing voltage signal of 0 to 1.2V on each data line SP and SN, as described in more detail below.

Further, the data signal lines SP and SN are bi-directional. In other words, data may be generated either by the host device 122 and sent to the client 130 using the data signal lines SP and SN, or data may be generated by the client 130 and sent to the host device using the same data signal lines SP and SN. The signaling follows specific protocols as set forth below.

The data signal lines use low voltage signaling, for example, 0 to 1.2V, and the differential signaling lines are shared by all devices coupled to the interface 150.

Figure 4:
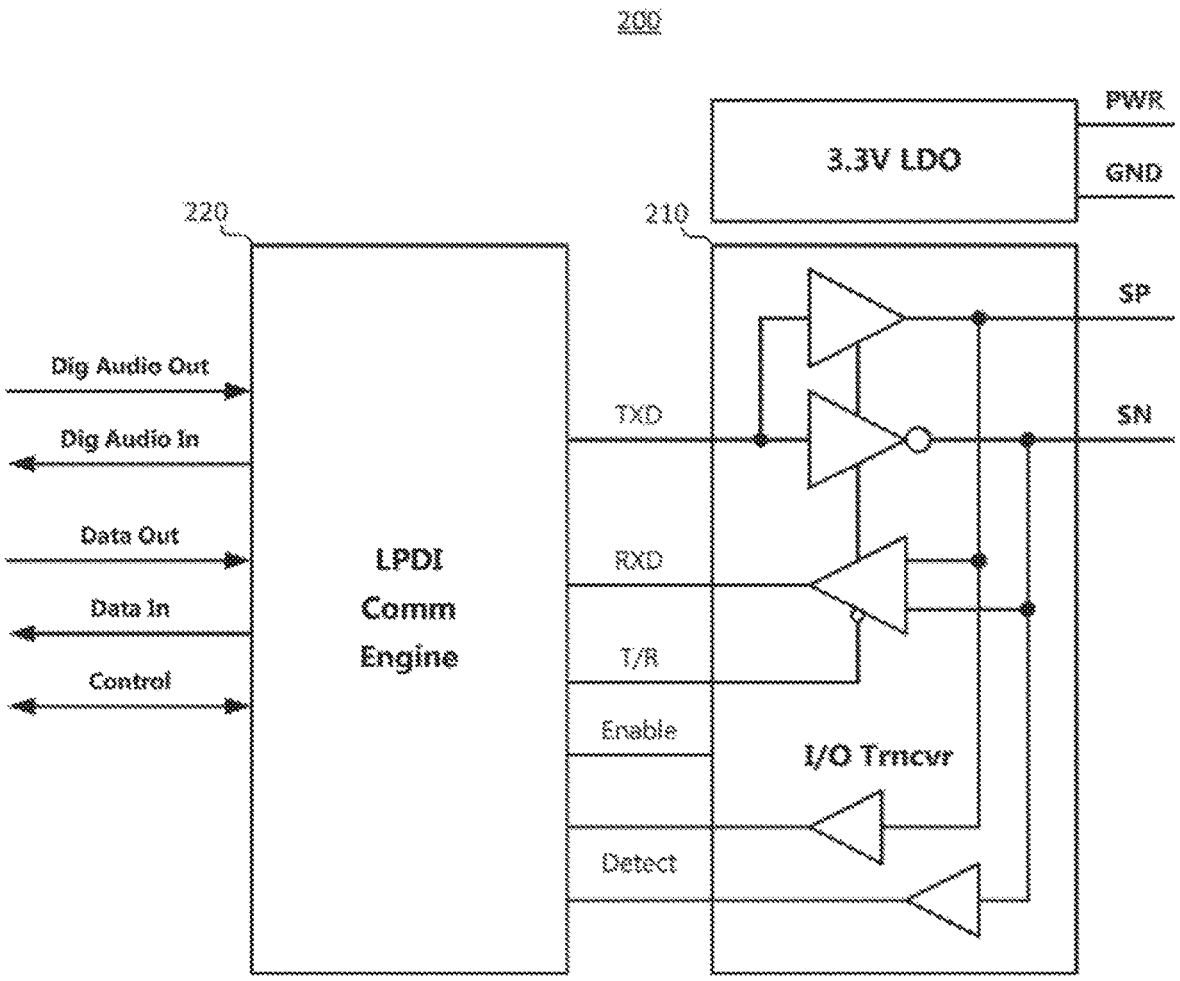
FIG. 4 is a simplified schematic diagram illustrating a transceiver portion of the interface illustrated in FIG. 1.

The interface 150 of FIG. 2 is controlled by a transceiver that is partially illustrated in FIG. 2 and more fully illustrated in FIG. 4.

An interface transceiver 200 illustrated in FIG. 4 for the interface 150 includes two major blocks, an I/O transceiver 210 and a communication engine 220. The I/O transceiver 210 is an example of the interface 126 illustrated in FIG. 2, while the communication engine 220 would be located, for example, within the host device 122 of FIG. 2.

The I/O transceiver 210 of FIG. 4 is the shared differential signaling line external interface for the data signal lines SP and SN. In one embodiment it generates the SP and SN signals from a signal-ended driver TXD from the communication engine 220. In other words, when the communication engine 220 places data on the TXD line, the I/O transceiver converts this into differential data to be placed on the SP/SN data lines. As mentioned above, the I/O transceiver 210 generates complementary 0 to 1.2V, and 1.2V to 0V signaling on the SP/SN lines. The signals on the SP/SN lines may be generated at either a 12 MHz or 12.288 MHz symbol rate, with one bit per symbol. This provides a raw data rate of 12 Mbps or 12.288 Mbps across the interface 150, depending on the particular clock being used. The signals on the SP/SN lines use bandwidth-limited pulse shaping.

The I/O transceiver 210 additionally includes a differential line receiver (Rx) structured to receive data from a client on the SP/SN data lines and send it to the communication engine 220 on the RXD line. This signaling system may be used for such purposes as enabling control by the client and detecting activity on the client.

The communication engine 220 may be embodied by a digital audio data interface, operating at, for example, 24 bit at 48 kHz. The communication engine 220 may operate as a general data interface, sending, for example, at least 64 bits every 1 ms. The communication has responsibility for packet assembly, frame synchronization and clock alignment, packet reception, packet disassembly, and computation of a Cyclic Redundancy Check (CRC). It may also be used to control search mode operation, silence detection and packet mute control, as well as data scrambling, if used.

Figure 5A:
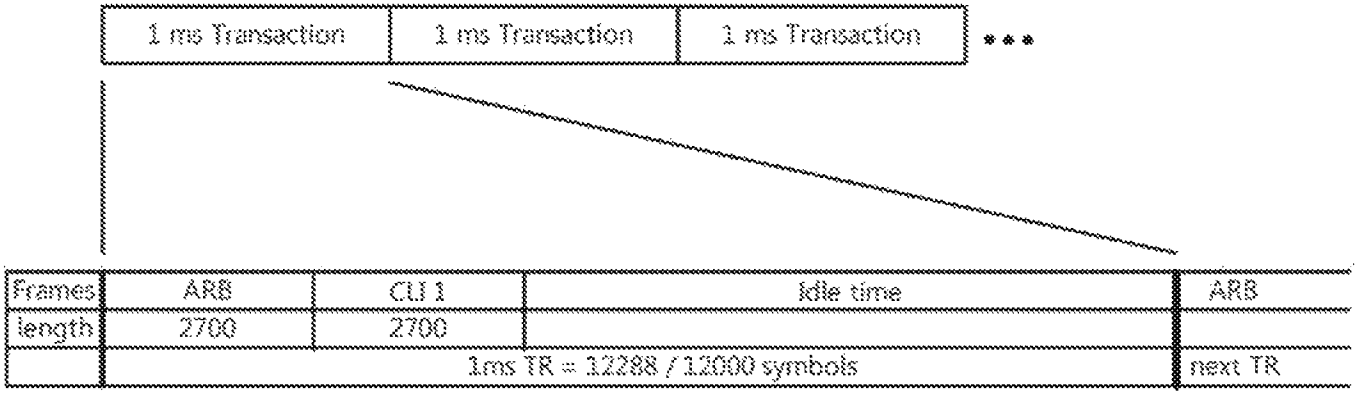
FIGS. 5*a* and 5*b* illustrate example protocol implementations of the digital interface of FIG. 1 according to embodiments of the invention.
Figure 5B:
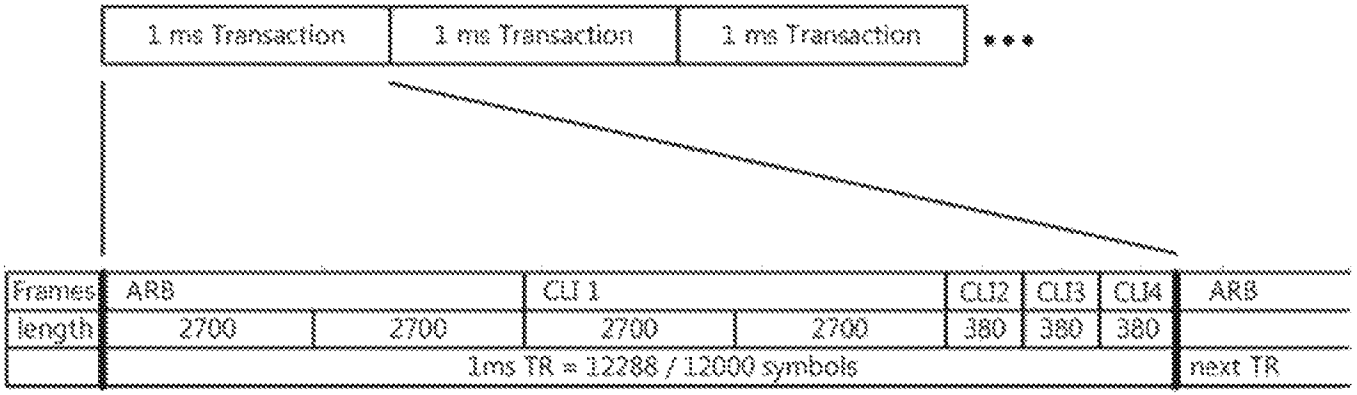
Figure 6:
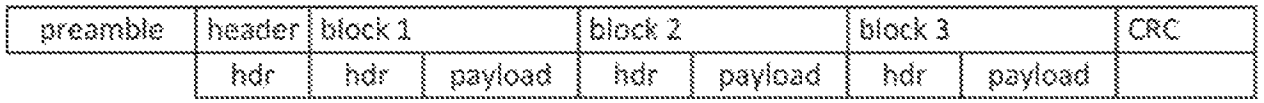
FIG. 6 illustrates a frame structure of the interface of FIG. 1 according to embodiments of the invention.

As illustrated in FIGS. 5*a*, 5*b*, and 6, the communication engine 220 and I/O transceiver 210 place data on the SP/SN data lines according to a protocol that uses transactions, frames, and packets. Data communication on the interface 150 (FIG. 2) is separated into 1 ms slices called transactions, as illustrated in FIG. 5*a*. Each device coupled to the interface 150 transmits one frame in each transaction when needed.

For most applications, fixed transaction length is applied. For fixed transaction length, each transaction is 12288 symbols long if 12.288 MHz clock is used. The transaction contains 12000 symbols if 12 MHz is used instead. However, LPDI supports variable transaction length which enables communication of variable audio sample rate. The frame structure and protocol is exactly the same for fixed transaction length and variable transaction length.

In the described embodiment of FIG. 5*b*, each transaction is divided into 7 fixed slots. The first 4 slots are audio slots. Each audio slot is 2700 symbols long. That includes 32 bit preamble, 256 bit header, 2 audio blocks of 1152 bits each, a 32 bit CRC and 60 symbol frame gap. The last 3 slots are header-only slots. Each of them is 380 symbols long. That includes 32 bit preamble, 256 bit header, 32 bit CRC and 60 symbol frame gap.

Each transaction is always started with an arbiter frame, denoted ARB in FIGS. 5*a* and 5*b*. The arbiter frame can be followed by up to 6 client frames. Each frame starts at the beginning of a slot.

The interface 150 can handle up to 4 stereo audio pairs. A stereo audio pair fits in an audio slot. An audio device may occupy more than one audio slot if it has more than one stereo audio pair to transmit.

If only the 12 MHz clock is available, this protocol would work with 12 MHz clock as well. In that case, the sample tick is always 250 cycles instead of 256 cycles.

FIG. 6 illustrates an example frame structure used in the interface 150 of FIG. 1 according to embodiments of the invention.

In general, the digital audio interface audio frame contains four major parts, a preamble, a header, an audio payload, and a CRC.

The preamble is used for frame synchronization for the physical layer, denoted as PHY. The length for preamble is 32 bits for all frames. The preamble is a 32 bit pseudo random sequence used to identify the start of frame. The preamble bit pattern can be programmable. The default value is 0×8F6E37A0, big endian.

The header consists of packet description, link information and some host data, and in some embodiments the maximal header length is 256 bits. The header contains 3 parts, PHY header, and MAC header. Variable frame length is possible; the frame length is indicated in the beginning of header. The recommended maximal length for PHY header plus MAC header is 256 bits. The CRC length in this embodiment is always 32 bits. That makes the maximal recommended header length to be 288 bits. The PHY header is 8 bits for client frame and 16 bit for arbiter frame. The client frame PHY header includes 3 bits for number of audio blocks to follow and 5 bits for number of MAC header bytes. The arbiter frame PHY header includes the above 8 bits, 7 bits of a slot bitmap indicating which slots are occupied, and one bit indicating whether it is accepting new client. The MAC header length in this embodiment is always specified in multiples of bytes.

The audio payload is optional. Some frames do not contain audio payload. The audio payload in this embodiment is always in formed in audio blocks. Each audio block may have variable length. Each audio block contains all audio data for 1 ms of a mono audio channel. The blocks are decoded and acknowledged independently. Each audio block contains an 8 bit block header, up to 1152 bits of audio data, 4 bits of block Id, 4 bits dynamic scaling info. The maximal length for a block is 1160 bits. Audio samples may be transmitted in big endian.

All audio blocks contain 48 samples. The sample width is decided by the dynamic scaling factor bits in the block header. Each block contains 48*(24-n) audio bits, where n is the dynamic scaling factor and all samples in the block has amplitude less than 2^(23-n). The total block length is 48*(24-n)+32+8. For the receiver, the length is decided after the first 8 bits, the block header. Each block contains a 32 bit CRC.

For data payloads, as illustrated in FIG. 6, each frame has a frame header. The frame header has variable length. The recommended maximal header length is 256 bits. That includes one byte of PHY header and the rest is data payload. That would provide maximal 248 kbps data throughput.

The payload blocks include a 16-bit block header indicating a block id and dynamic scaling information, up to 1152 bits of data, which in the headphone embodiment, may include audio data. The audio payload in this embodiment always contains 48 samples. The length of the audio payload is given by 48*(24-dynamic scale bits). This combination at the specified clock rate gives a maximum digital audio capacity of 8 mono audio channels at 48 KHz, 24 bits each.

If the header length bits or the block dynamic scale bits are corrupted, the rest of the frame is also corrupted. But this is not a major issue since the link is very reliable link and collision cannot happen.

The CRC has 32 bits and covers the entire frame, including the header and audio payload. The CRC polynomial is programmable, the default value is 0×04C11DB7.

The whole frame, except the preamble, is scrambled to avoid consecutive zeros and ones. Data scrambling may be implemented by a common pseudo random sequence on both sides. The scramble technique is LFSR (Linear Feedback Shift Register) based. The scrambling polynomial and initial seed are programmable. The default value is polynomial 0×814141AB, initial seed 0×80000000.

The start of frames may be fixed for all devices. Therefore, collision would not happen any time except for the low possibility during initial link-up.

With reference back to FIGS. 5*a* and 5*b*, FIG. 5*a* illustrates an example transaction structure for two devices, an arbitrator (ARB) and a client (CL1), each device transmitting two audio channels. FIG. 5*b* illustrates an example transaction structure having five devices, an arbitrator (ARB) and four clients (CL1, CL2, CL3, and CL4), with two devices (ARB and CL1) transmitting four audio channels, and 3 devices (CL2, CL3, and CL4) transmitting only data.

Figure 7:
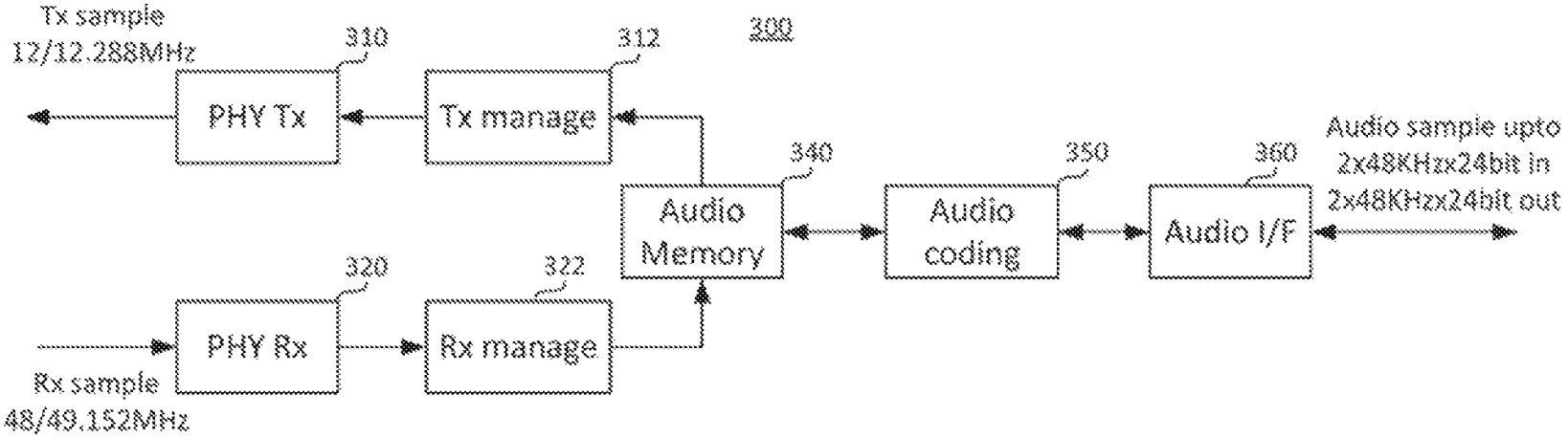
FIG. 7 is a simplified functional block diagram illustrating operation of the interface of FIG. 1.

FIG. 7 is a functional block diagram illustrating how a communication engine 300, for example the communication engine 220 of FIG. 4 operates to place data onto and take data from the interface 150.

Interface hardware in the communication contains 300 includes a physical transmitter 310, labeled PHY Tx, which receives a bit stream as an input and generates a differential analog signal on its output. A transmitter manager block 312 generates the bit stream for the physical transmitter 310.

A physical receiver 320, labeled PHY Rx, receives a differential analog signal as its input and generates a bit stream as an output. A receiver manager block 322 is coupled to the physical receiver 320. The receiver manager block 322 turns the received bit stream into audio samples and writes them into the audio memory.

An audio memory 340 is sized large enough to contain 2 ms audio data for 8 mono channels, i.e., at least 768 words of 24 bit width.

An audio coding block 350 encodes audio data to be transmitted in a more efficient form to reduce transmission bandwidth. It also decodes the received audio data to normal form before it is sent to an audio interface 360. The audio interface 360 reads audio samples from the audio memory 340 and sends to a Direct Memory Access (DMA) engine (not illustrated), which is a typical way to write and read from a memory. It also takes audio samples from the audio DMA and writes them into the audio memory 340. The audio interface 360 also generates audio sample strobes to control the audio DMA.

In more detail, the physical transmitter 310 uses a simple approach. In one embodiment the physical transmitter 310 is embodied by a pulse shaper on a 12.288 MHz input bit stream. The pulse shaper may be as simple as a RC circuit. The physical transmitter also functions to insert preambles and CRCs At the beginning of transmitting a frame, a frame start pulse is issued to the physical transmitter 310, which starts the frame by outputting a pre-stored preamble word, one bit each cycle. In one embodiment the preamble is big endian, meaning the higher order bits goes first.

After the preamble word, the physical transmitter 310 takes the frame header from the transmitter manager 312 and sends it as well. Again, it is big endian in some embodiments.

After the header, the physical transmitter 310 transmits all of the audio blocks one by one. The length of each audio block is provided by the transmitter manager block 312.

During transmitting header and audio blocks, the CRC block is always on. After the end of last audio block, The CRC word is transmitted. Again, it is big endian. The CRC may be computed using, for example, a Linear Feedback Shift Register.

For all header, audio block and CRC bits, scrambling is applied to avoid consecutive zeros or ones. The scrambler may also be a LFSR register with a programmable polynomial and initial seed. The scrambler generates a pseudo random bit every cycle and it is XORed to the Tx bit.

The transmitter manager 312 has specialized functions to support the physical transmitter 310. The transmitter manager 312 starts before the beginning of frame header. First, it decides how many audio blocks are transmitted. The number of audio blocks depends on the number of active channels and the silence detection result.

The transmitter manager 312 takes the desired MAC header from the processor and generates the PHY header with the number of audio blocks and the MAC header length. Then it outputs the PHY header and MAC header to physical transmitter 310. For each transmitted block, it includes the coding information in the block header.

If the audio block is uncompressed audio, the block header is 1 byte. The following fields are in the block header A coding bit=0, indicating the block does not use coding. A two-bit block id, which is sufficient since each frame cannot contain more than 4 blocks. Then five-bit dynamic scaling info is inserted, i.e., the MSB position of transmitted audio samples. This decides the block length and also enables receiver to realign audio samples properly.

If the audio block is compressed audio, the block header has 3 bytes. IN this case the coding bit is set to "1", indicating the block uses coding. The two-bit block id is followed by the five-bit dynamic scaling info for each of the four audio sample sectors. Finally, a final bit may be reserved.

After the block header, the transmitter manager 312 converts audio data from the audio memory 340 into bit streams, and at the end, it leaves 32 bits blank space for CRC, which is placed in stream by the physical transmitter 310.

The physical receiver 320 is more complex than the physical transmitter 310. First, a 49.152 MHz over sampled comparator is used to generate a 4× oversampled bit stream. This provides for accurate data detection.

The physical receiver 320 includes two major sub-blocks. One is the preamble detection and frame time recovery sub-block, and the other is the data receiver and time adjustment sub-block. The preamble detection and frame time recovery sub-block could work in two modes—a search mode and a "know time frame" receive mode.

The difference of the two modes is the size of frame preamble detection window size. The search mode has an infinite detection window and the known time mode has a limited time window for preamble detection.

The physical receiver 320 gets the frame start pulse several cycles before the actual start of frame. For the search mode, there is a start search pulse instead.

Then the physical receiver 320 correlates the received oversampled bit stream with the known preamble pattern. The highest peak gives the best symbol and frame timing.

Within the data receiver and time adjustment sub-block of the physical receiver 320, after the preamble correlation peak is detected, every 4th value of the oversampled bit stream is sampled as the raw received bits.

To resolve possible clock drift between the physical transmitter 310 and the physical receiver 320, the bit transitions for all 4 taps in the symbol are tracked and the symbol timing may be adjusted mid frame as directed by transition count.

For example, assume the current tap is n. Ideally all the bit transitions should happen between tap n+2 and n+3, or n+1 and n+2. If a bit transition is detected between n+3(same as n−1) and n, data is sampled at tap n+1 instead, since tap n is close to symbol boundary and is less reliable than tap n+1. Likewise, if a bit transition is detected between n and n+1, data is sampled at tap n−1 instead, since tap n is less reliable than tap n−1.

After the preamble is detected, an LFSR scrambler is reset and starts operation. The LFSR scrambler may be exactly the same hardware as in the physical transmitter 310. The scrambler output bit is XORed to the received raw bit to get the received bits from the physical receiver 320.

The CRC LSFR also resets at the detection of preamble. It is also the same hardware as the CRC in the physical receiver 320. It also behaves the same as during data transmission. At the end of last audio block, the CRC word in the LFSR register is compared to the CRC word received. The CRC check passes if both have the same value.

The receiver manager 322 is also complex. Processing data with the receiver manager 322 starts at the beginning of frame header. The receiver manager 322 sets all blocks expected to be received in the frame as bad to start, and then looks at the PHY header and decides the header length and number of blocks to receive. The receiver manager 322 then records the MAC header and passes it to the processor.

For each block, the receiver manager 322 reads the block header, and retrieves the block id and dynamic scaling factor. The dynamic scaling factor is different for each sector if the audio block is coded.

From dynamic scaling factor, the receiver manager 322 decides the sample width, and turns the input bit stream into audio samples and writes them into the audio memory 340. At the end of the frame, the receiver manager 322 clears the bad audio block flag in the audio memory 340 for all received audio blocks, if the CRC check passes.

The audio memory 340 contains, for example, a 768×24 RAM. It should also contain the address management, such as the DMA engine, and arbitration management. The memory arbitration should give higher priority to the transmitter manager 312 or the receiver manager 322. The reason is that these blocks are operated in a cycle accurate manner, and the audio samples are stored or provided immediately to avoid register overwriting or transmitting the wrong value. The audio memory 340 should include bad sample flag. If for some reason, an audio block is bad or not received, the corresponding audio samples should be cleared to 0.

The audio interface block 360 generates 48 sample ticks evenly over 1 ms transaction time. With 12.288 MHz clock that is 256 ticks per sample. With 12 MHz clock, it is 255 ticks per sample.

At every sample tick, the audio interface block 360 takes an input sample or generates an output sample for every active audio channel. Corresponding memory accesses are generated to provide or store the samples from or to the audio memory 340.

The audio coding block 350 handles audio encoding and decoding.

The communication engine 300 uses three mechanisms to reduce over the air audio data bandwidth.

First, the engine 300 uses audio silence detection. If the audio is lower than a certain threshold during the entire audio transaction, the audio data is marked as zeros and the physical transmitter 310 skips transmitting them. This happens very frequently when audio is not being played, and all that is left in the audio channel is noise from audio processing. Embodiments take advantage of this behavior.

Second, the engine 300 uses audio dynamic scaling. If the audio during a transaction time is always of low amplitude, all higher order bits are always exactly the same. Then, sending the higher order bits are skipped to reduce the physical transmitter 310 bandwidth to save power. If the maximal amplitude during a transaction is smaller than 2N, only N+1 bits are needed to be sent instead of sending all 24 bits.

Figure 8:
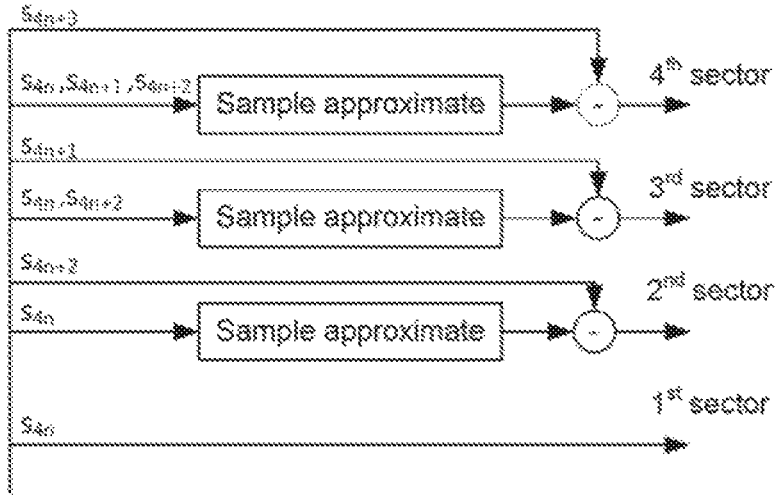
FIG. 8 is a block diagram of an example encoder for use with the interface of FIG. 1 according to embodiments of the invention.

Third, the engine 300 uses efficient audio coding. The idea of this coding mechanism is to divide the audio data into several sectors. It uses the fact that for all music pieces, most of the energy concentrates in low frequency. One example divides the audio data into four sectors. An encoder and decoder are illustrated, respectively, as FIGS. 8 and 9.

For the first sector, it includes every 4th sample (sample 4n) in each transaction; the original form of audio is preserved. Of course, dynamic scaling can be applied.

Figure 9:
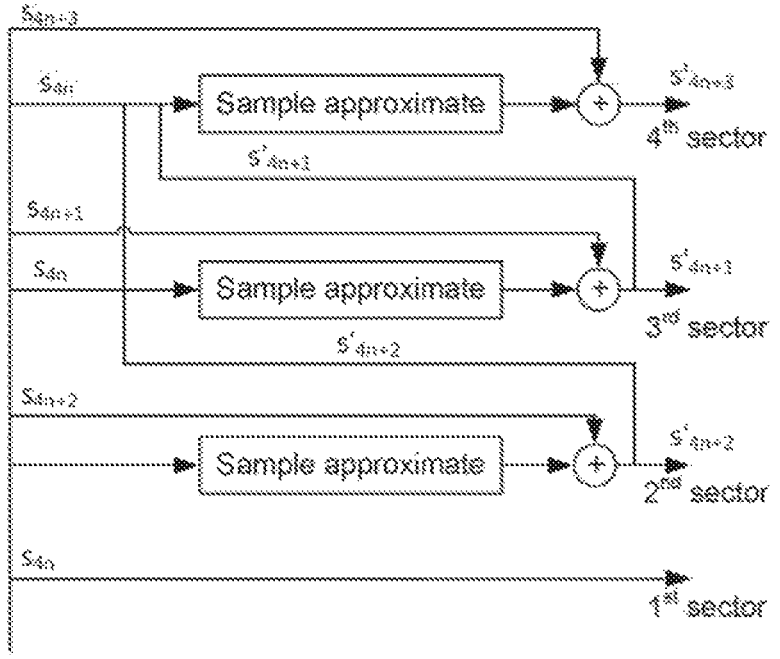
FIG. 9 is a block diagram of an example decoder for use with the interface of FIG. 1 according to embodiments of the invention.

The second sector includes samples 4n+2 in each transaction. The encoding is applied. Instead of just using the audio samples in its original form, an estimation of these sample is first made by applying a polynomial fitting over the sample in the first sectors. The estimated values are certainly not the same as original, but the value is close enough. The difference of samples 4n+2 and the estimated values are the result of encoding. Since the amplitude of the difference is significantly smaller than the original value, fewer bits are required over the physical transmitter 310 interface. Decoding, as illustrated in FIG. 9, is done in the same way. From the samples in first sector, the estimated value is computed for samples 4n+2. Then the encoded value, i.e. the difference, is added to the estimated sample values. The audio sample can be reconstructed. The reconstructed sample is guaranteed to be exactly the same as original sample before coding, bit by bit.

The third sector includes samples 4n+1 and the fourth sector includes samples 4n+3. The coding method is the same as in second sector. The difference is that samples in both first and second sector can be used to approximate sample in the third sector; use samples in sectors 1~3 to approximate sample in the fourth sector. The estimation is more accurate and the difference is even smaller. As a result, a higher efficiency can be achieved in this sector.

For typical music pieces, embodiments of the invention can achieve 30% ~40% savings using the above-described encoding method. The decoded result is guaranteed to be exactly the same as original audio data, bit by bit. The extra hardware and current consumption is minimal.

The audio data overhead size increases slightly since amplitude information is included for each sector instead of just one value for all audio samples in the transaction.

Referring back to FIGS. 2 and 3, Embodiments of the invention include systems for managing network configuration changes, such as when devices are added, removed, are changed from audio to header only, or vice-versa, or when audio slots are added or reduced for a device.

To add new devices, the arbiter, such as the host device 122, is first in an "admitting new device" mode. This is indicated by a flag in the arbiter frame PHY header. The devices waiting to join randomly pick an unused slot as indicated in the PHY header. If the client 130 wants to send audio, it should pick an audio slot, otherwise, it selects a header only slot.

The arbiter grants the access on a new client by setting the corresponding slot bit to 1 in the next arbiter PHY header. If the client 130 does not see the change in slot map, a collision happens. In that case, it picks a random back off number. It would only apply again after the back off number is reduced to 0 again.

If the client 130 is accepted, then it sends frames in the desired slot.

If the arbiter does not receive any frame from a client 130 for an extended time, then the client is dropped from the network by clearing the corresponding slot.

Changing clients between audio device and header only device can be achieved by dropping the device from the network and rejoin again.

Reducing audio slots for an arbiter or client is easy, and may be implemented by changing the slot mask. Adding audio slots when the adjacent slot is available is also easy, and is effected by changing the slot mask.

Adding an audio slot when the adjacent slot is not available is more difficult. To add the audio slot involves moving the current client that is occupying the adjacent slot to a different slot. After that is completed, a slot can be added to the desired client by changing the slot mask as described above.

A unique mode used by embodiments of the invention is a low power search mode, which searches for devices being added to the interface 150 (FIG. 2) while using very low power. This mode is used when there is no active audio communication going on. During those conditions, the transmission line is not driven by any device, and all devices monitor the transmit line for toggles. Any device, such as a client 130, wanting to activate communication sends a toggling sequence, which may be simple as a 0101 sequence. All devices wake up after detecting the toggle signal, and are reset back to the active state again.

There is a simple interface option for embodiments of the interface 150. In such an embodiment, only two devices are allowed, one arbiter and one client. Each device sends at most two mono channels and a data payload is 64 kbps. In this mode the interface 150 may be working without constant processor intervention. The only thing the processor should do is to get the received MAC header from a register and store the transmit MAC header to a register. In this embodiment the size of the audio memory may be much smaller than in other embodiments. As a result, the current consumption is very small for such applications.

Figure 10:
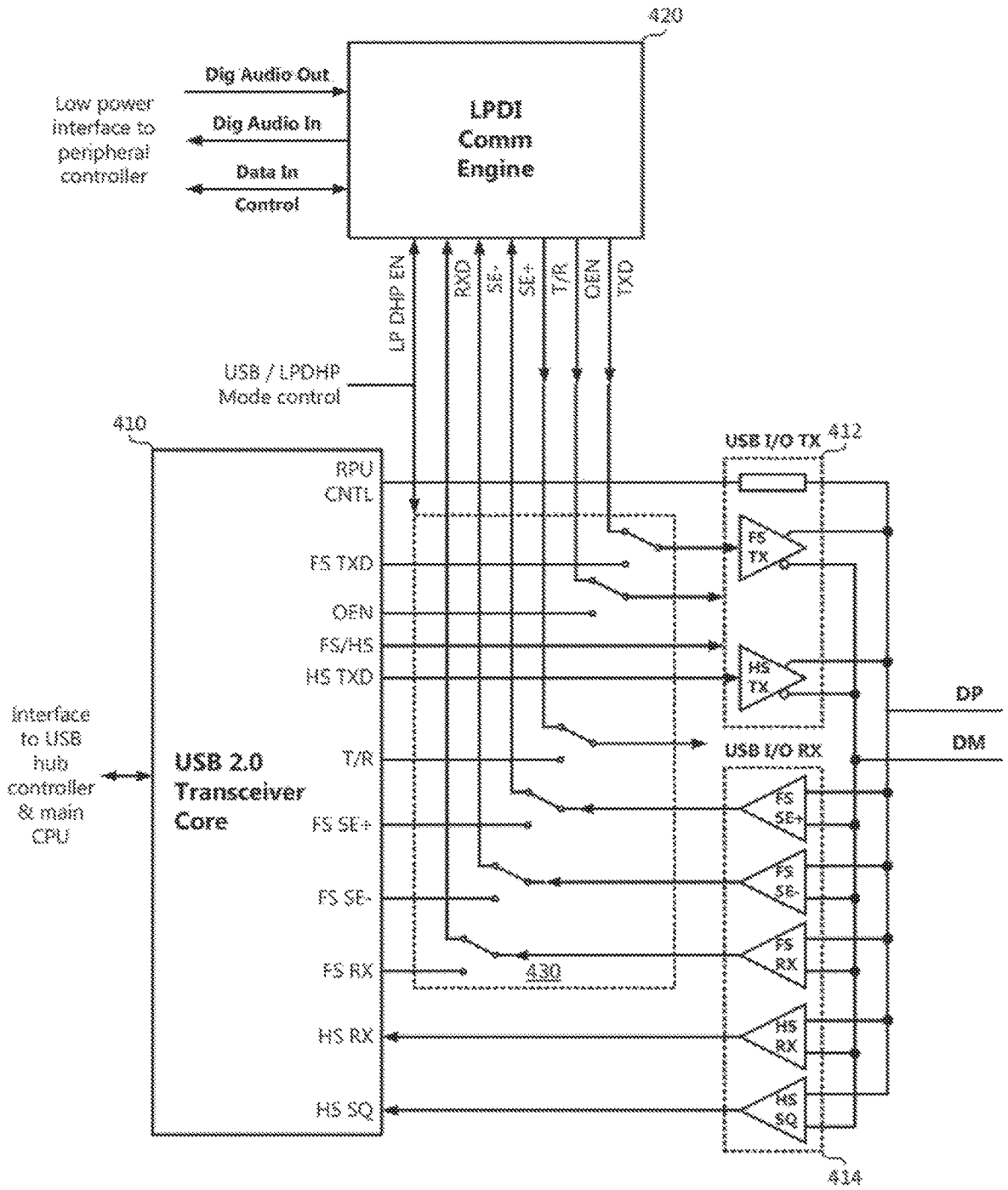
FIG. 10 is a simplified schematic diagram illustrating how the interface of FIG. 1 may be used in a legacy USB system.

FIG. 10 is a simplified schematic diagram illustrating how the interface 150 of FIGS. 1 and 2 may be used in a legacy USB system.

In such a system, the interface 150 can share usage of the 4 connector pins of the USB connection, including the two power connections, VBUS and GND (not illustrated, and the data lines DP and DM, as well as the I/O transceiver 412, 414.

In USB legacy mode, the USB interface may operate according to the USB 2.0 standard. In a LPDI mode, the interface 150 uses an existing USB I/O transceiver 412, 414, but the USB transceiver is multiplexed through a digital multiplexer 430 to a communication engine 420, which may be an example of the communication engine 220 of FIG. 4. In this embodiment, the communication engine 420 and the USB transceiver core 410 may be disabled to save power.

As seen in FIG. 10, the integration uses the same 4 pin USB jack as well as the USB full speed I/O transceiver 412, 414.

For management, embodiments of the invention may enumerate a device using the USB bus but operating over the interface 150 as a special USB device, and then switch from the USB core transceiver 410 to the communication engine 420. This allows embodiment of the interface 150 to connect to a mobile device peripheral chip set with a low power interface, e.g. I2S+I2C.

Figure 11:
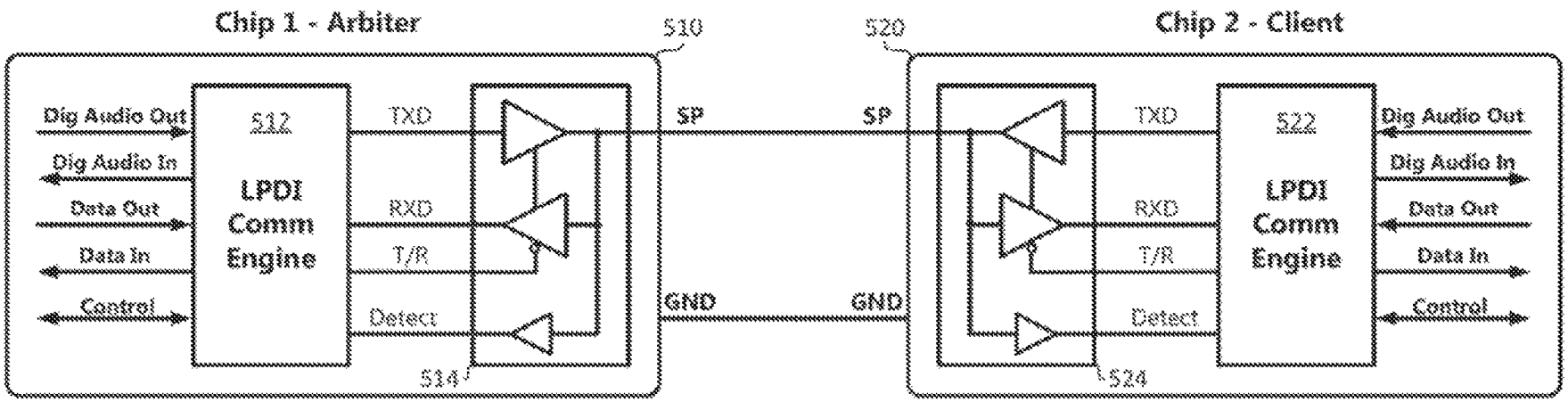
FIG. 11 is an example embodiment of the interface according to embodiments of the invention using a single wire.
Figure 12:
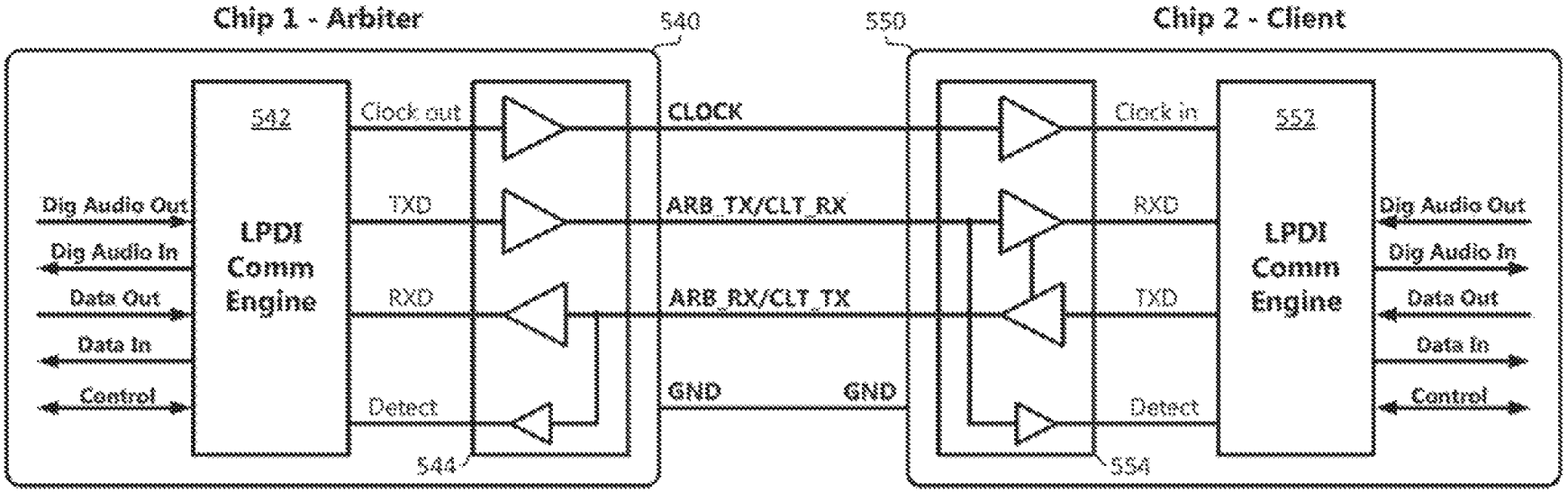
FIG. 12 is an example embodiment of the interface according to embodiments of the invention using three-wire interface.

All of the embodiments of the interface 150 described above use the well-described four-pin or four-wire configuration. As illustrated in FIGS. 10 and 11, embodiments of the invention may be expressed using a single wire interface, as illustrated in FIG. 10, as well as a three-wire interface, as illustrated in FIG. 11. These embodiments may be particularly suited for providing a very low power inter-chip connection.

Such a connection would typically cover distances of up to a few centimeters. In such applications, a transmission line model is not necessary. A simple single ended logic level connection would be sufficient. EMI would also not be a major concern.

There are two different physical I/O interfaces that may be used for the inter-chip connection embodiment depending on implementation. The two physical interfaces are illustrated in FIGS. 10 and 11.

The single wire interface embodiment is illustrated in FIG. 10. It can be thought of as an equivalent or similar to the SP line described above. The two connected chips would share the same ground, which typically does not cost any extra pins. The protocol would be exactly the same as the protocol described above for the above-referenced interface 150. The signal line SP in FIG. 10 is connected to essentially the same, simple bi-directional driver-receiver digital I/O circuit, such as described in FIG. 4 above. In the driver mode, an LPDI TX logic output signal is sent from a communication engine 512 in a device 510 to a buffer driver 514 input. In a receiver 520, the LPDI RX logic input in a communication engine 522 receives input from a buffer receiver 524 output. The interface 150 logic described above remains the same and performs the same functions as described previously.

Another physical interface is a three-wire interface, as illustrated in FIG. 11. The three wires are; 1) clock, 2) arbiter_TX/client_RX, 3) client_TX/arbiter_RX. The two chips or devices 540, 550 would share the same ground, which does not cost any extra pins. The three wire physical interface requires a slight change of the interface protocol LPDI described above. In this embodiment, The clock and arbiter_TX signal pins are driven by the arbiter, such as the device 540, while the client_TX signal pin is driven by the client, such as the device 550. The advantage of this interface is that each pin is only driven by a single chip or device, which allows full duplexing of signals. This increases the maximal data throughput, or reduces the overall duty cycle of the interface. It also removes the need for clock recovery and bit stuffing. The difference from the logic driving the interface 150 described above is the ability to handle data transmit (TX) and data receive (RX) simultaneously. The 3 wire physical interface illustrated in FIG. 11 makes the LPDI digital logic more simple since it removes the requirement for clock recovery.

Figure 13:
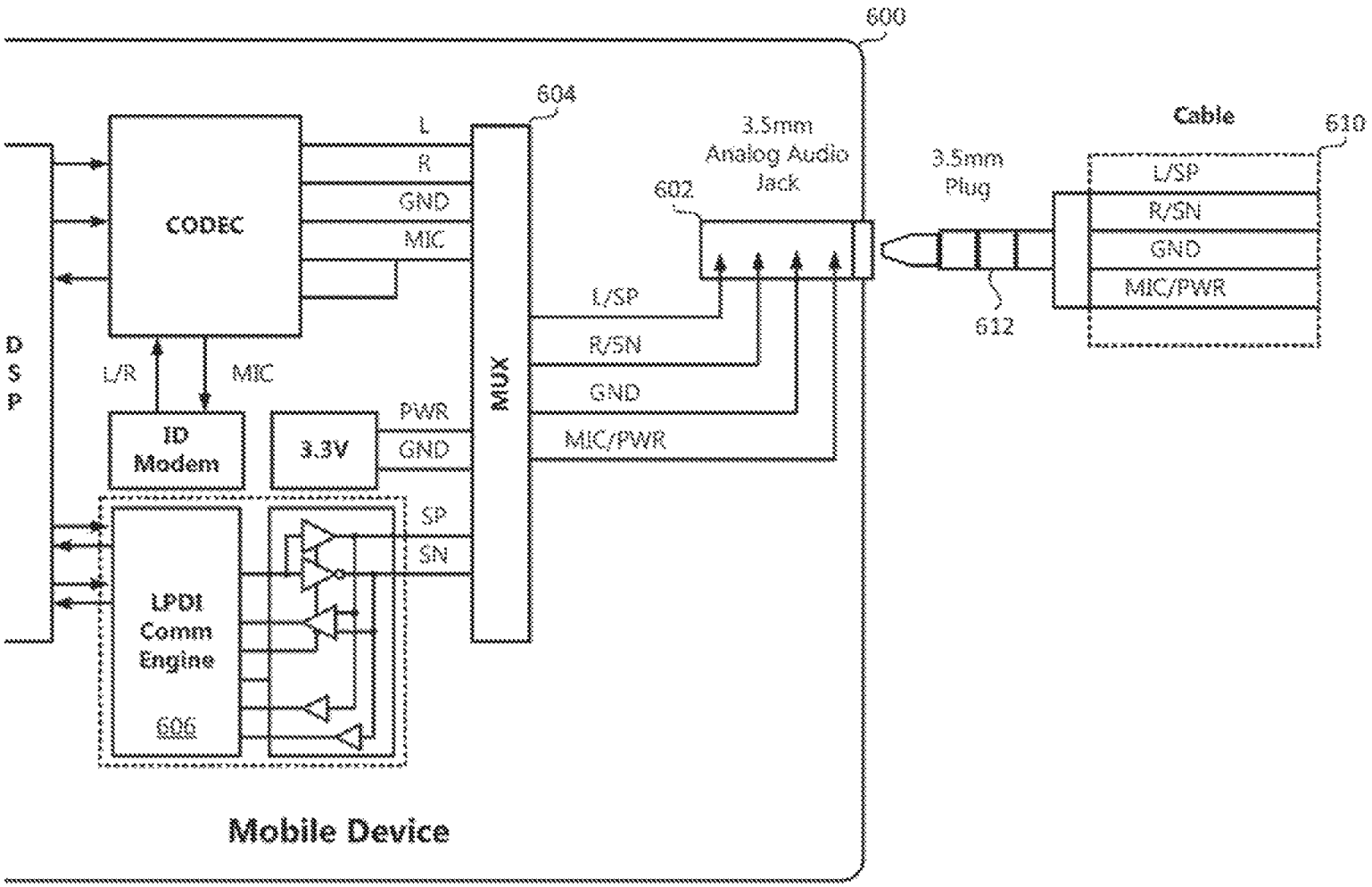
FIG. 13 is a simplified schematic diagram illustrating how the interface of FIG. 1 may be used in a legacy system.

Returning back to description of the four-wire implementations of the interface 150 illustrated in FIG. 1, FIG. 13 is a simplified schematic diagram illustrating how the interface 150 of FIG. 1 may be used in a legacy system 600 to integrate a digital headphone with a legacy analog headphone jack 602.

It is possible to integrate digital headphone capability into the legacy analog jack 602 and eliminate a need for a separate 4 pin jack for the interface 150 of FIG. 2. The four pins of a standard 3.5 mm connection (TRRS: tip, ring, ring, sleeve) are typically connected to the analog signals Left, Right, Gnd and Mic of the device 600, as illustrated in FIG. 5. The interface 150 of FIG. 2 can be made to share usage of the 4 connector pins (TRRS) through an analog multiplexor circuit 604. In analog legacy mode, L, R, Gnd and Mic signals of the analog CODEC are connected to the 4 pins of the 3.5 mm jack 602, and in digital headphone mode, the SP, SN (from an interface communication engine 606), as well as Gnd and Power from the device 600 are connected to the 4 pins of the 3.5 mm jack 602.

In analog mode, when legacy or legacy capable headphones are connected to the cable 610, the system works as previously, with analog signals provided at the audio jack 602, which are carried to the headphone line 610, in which case would carry analog signals to the headphones.

In the digital mode, i.e., when digital headphones are coupled to the headphone line 610, the multiplexer 604 provides digital signals to the audio jack 602 according the interface protocol 150 described above. In this case a decoder coupled to the headphone line 610 acts as a client on the interface 150, and decodes the audio signals into an audio signal, such as illustrated in FIG. 1 above. In such an embodiment, an identification circuit may be used on a mic input line on the headphone line 610 received at the jack 602 to detect the presence of headphones capable of using the digital audio interface 150, and switch over to the digital headphone mode.

Figure 14:
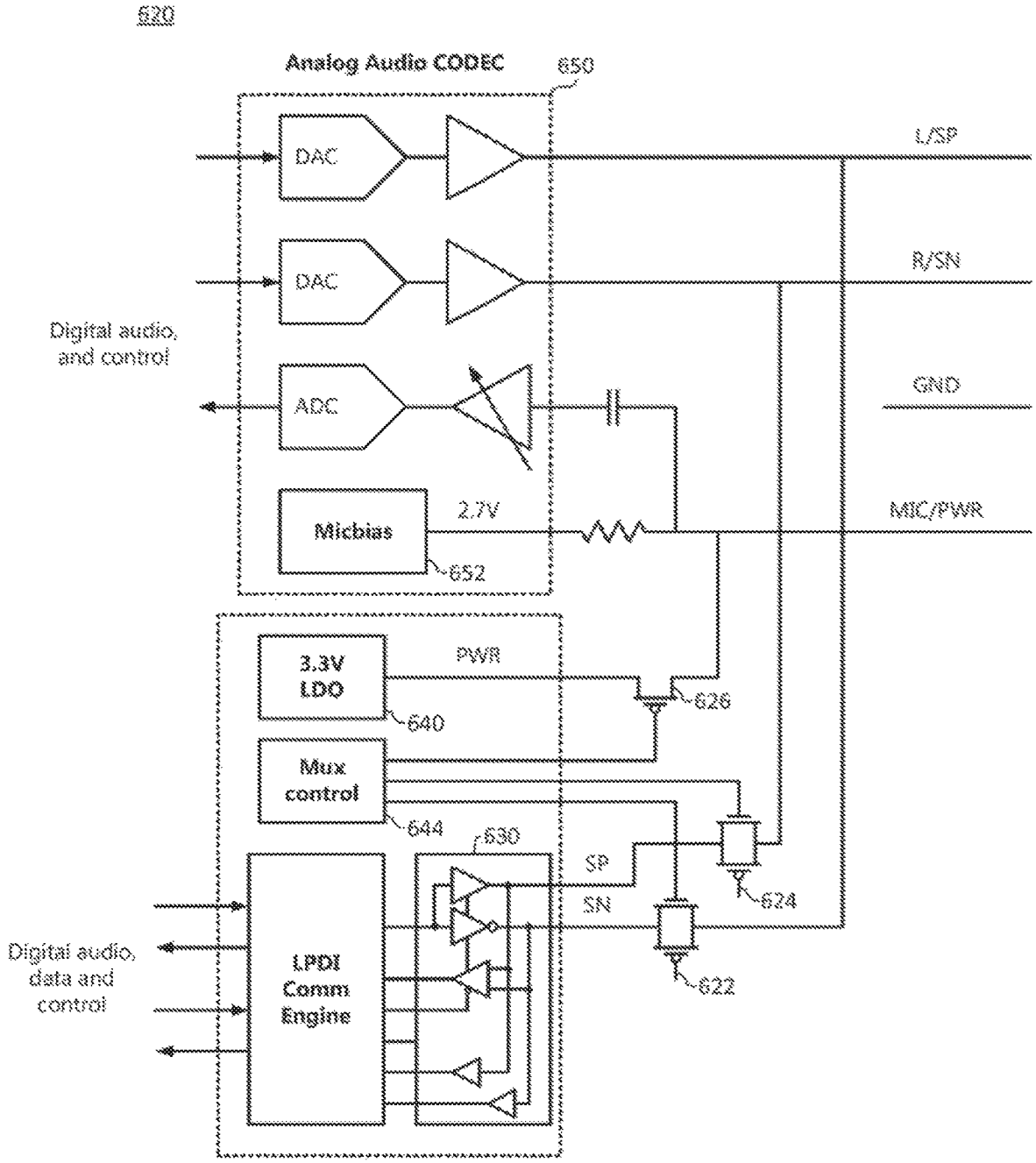
FIG. 14 is a schematic diagram providing additional detail of a multiplexor circuit used in the interface of FIG. 1.

FIG. 14 is a schematic diagram providing additional detail of the analog multiplexor circuit 604 of FIG. 13 that may be used with the interface of FIG. 1. In particular, an analog multiplexor 620 may be an example embodiment of the multiplexor circuit 604 of FIG. 13.

The analog multiplexor function may be achieved with components as illustrated in FIG. 14. The multiplexor 620 includes analog CMOS switches 622, 624, in series with a transceiver interface 630. A PMOS transistor 626 is in series with a 3.3V regulator 640. The switches 622, 624 and transistor 626 are controlled by a multiplexor controller 644.

A headphone amplifier 650 has a high impedance output state when in the "off" mode, allowing digital signals from the transceiver 630 to be applied to the headphone wires.

A microphone bias component 652 and microphone pre-amp input also have a high impedance state in the "off" mode.

In the analog headphone mode, the signal lines of the transceiver 630 and 3.3V regulator 640 are disconnected from the pins of the 3.5 mm jack by turning off the analog CMOS switches 622, 624, and PMOS transistor 626. The headphone amp 650, microphone pre-amp, and microphone bias 652 are connected to the pins of the 3.5 mm jack by powering on these blocks.

In the digital headphone mode, the signal lines of the transceiver 630 and 3.3V regulator 640 are connected to the pins of the 3.5 mm jack by turning on the analog CMOS switches 622, 624, and PMOS transistor 626. The headphone amplifier 650, microphone pre-amp and microphone bias 652 are disconnected from the pins of the 3.5 mm jack by powering off these blocks.

Figure 15:
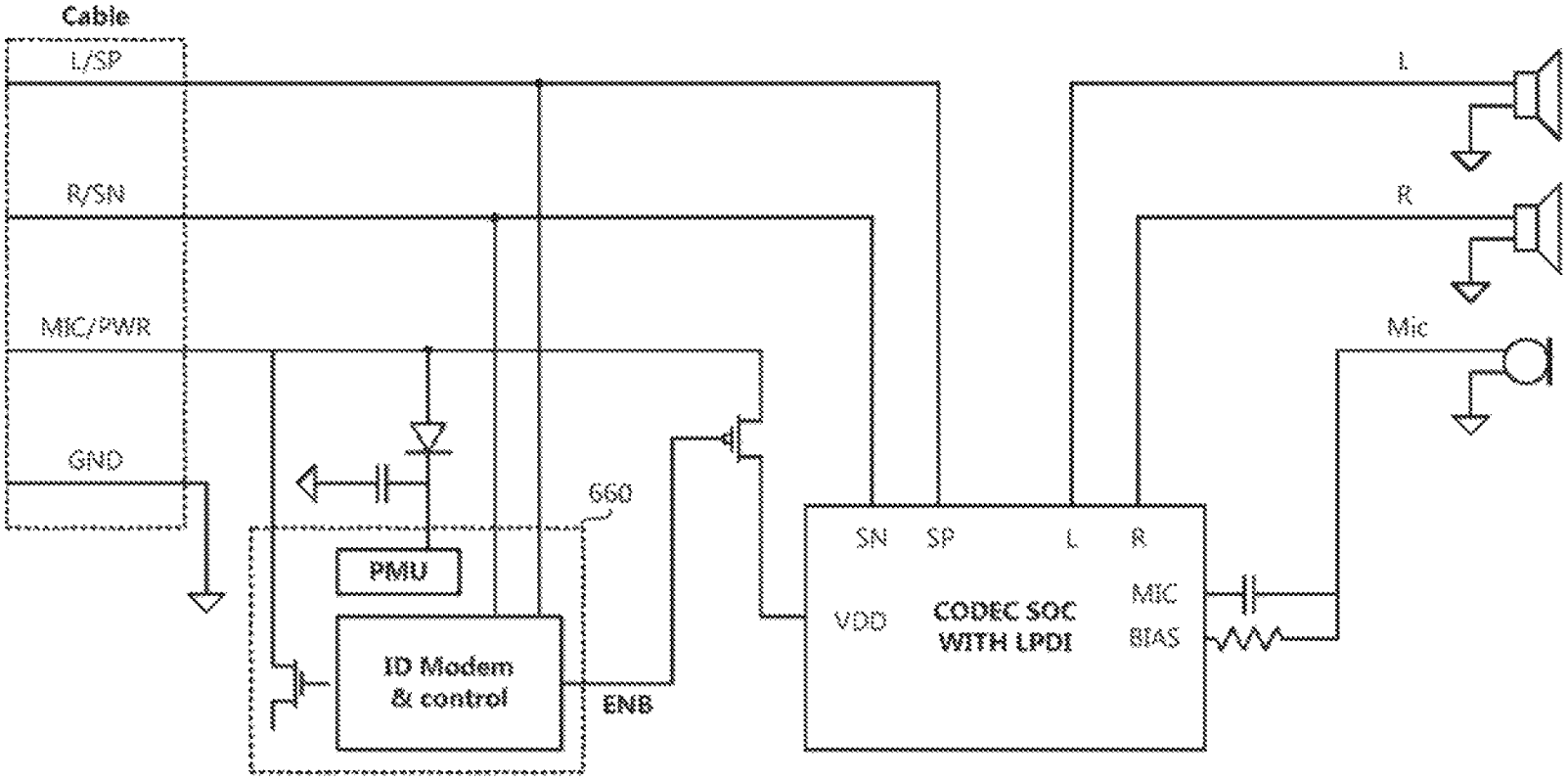
FIG. 15 is a simplified schematic diagram further illustrating how the interface of FIG. 1 may be used in a system that supports legacy operation as well as digital operation.

FIG. 15 is a simplified schematic diagram illustrating components that may be used in the interface of FIG. 1 according to embodiments of the invention.

When plugging into, for example, a headphone jack that is coupled to the interface 150 of FIG. 2, which may include default legacy analog headphone support, embodiments of the invention may provide an ID modem and LPDI enable control function into the digital headphone, as illustrated in FIG. 15. This can be accomplished with an ultra-low power ID modem 660 that is initially powered from the microphone bias line going to the microphone. The ID modem 660 would operate like an ultra-low power audio frequency ID modem circuit, which is conceptually similar to 125 kHz RFID.

Upon first power-up through the MIC line, the client ID modem 660 modulates the MIC line with a digital code word appropriately modulating a hypersonic (>20 kHz) signal. The host ID modem (not illustrated) is in a waiting state waiting to receive a modulated hypersonic (>20 kHz) signal containing the unique digital code from a modem in the interface 150 coupled to a digital headphone. The host ID modem (not illustrated) demodulates the hypersonic MIC input signal, compares the demodulated digital word to the stored unique word which indicates that the client wishes to activate the digital interface mode in the host. If the code word matches, the host ID modem enables the power line of the digital interface 150 (PWR), and responds back to the client ID modem with an enable code word by modulating an audio signal on the L and/or R output. The client ID modem 660 demodulates the signal and compares it to the stored unique enable word. If the code word matches, then the client ID modem enables power (PWR) to an interface chip for the digital interface 150 located within or coupled to the digital headphones, and the digital headphones begin operating in the digital mode.

Figure 16:
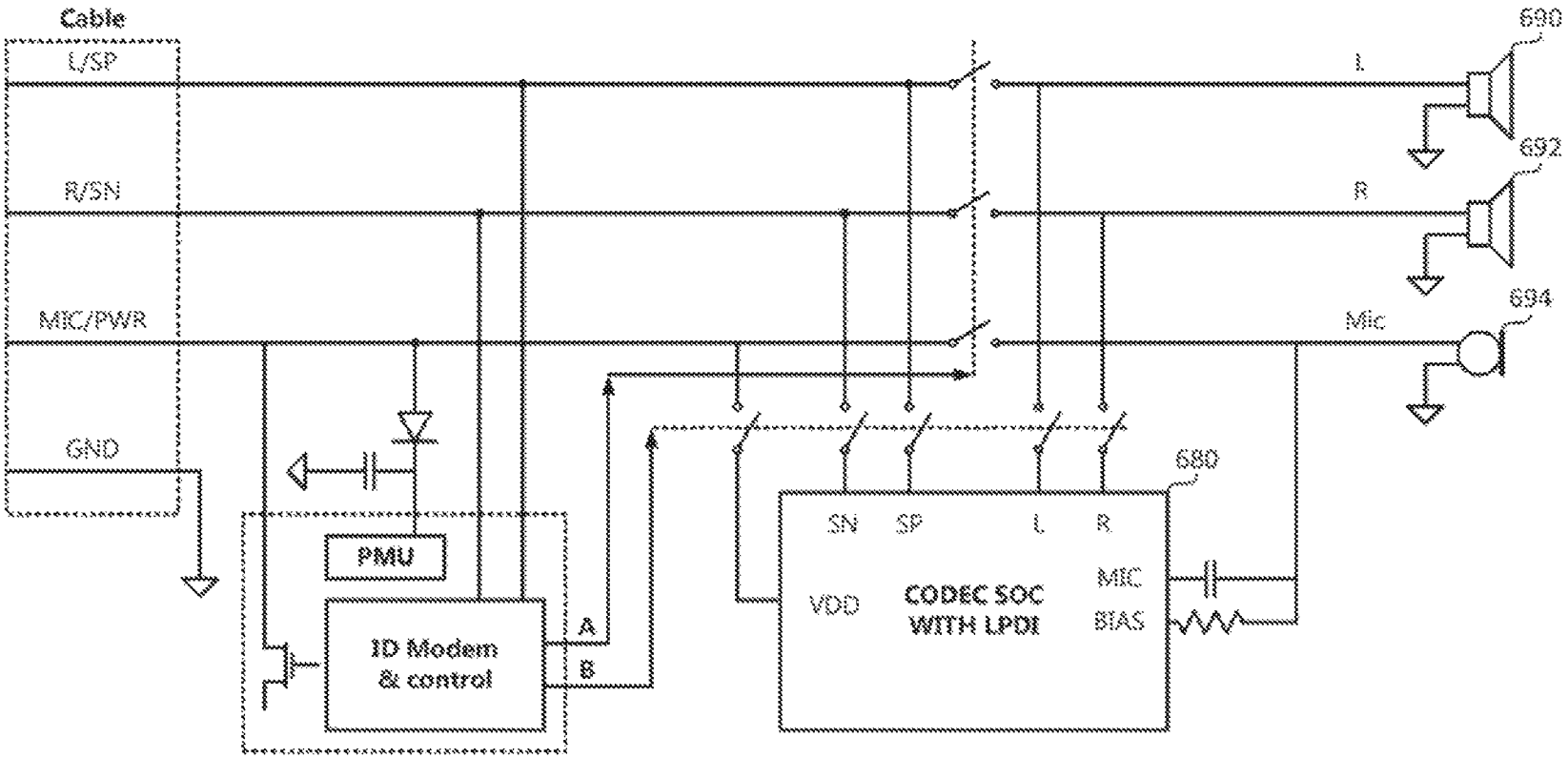
FIG. 16 is a simplified schematic diagram illustrating components that may be used in the interface of FIG. 1 according to embodiments of the invention.

FIG. 16 is a simplified schematic diagram further illustrating how the interface of FIG. 1 may be used in a legacy system.

In a headphone product, it may be desirable to support a passive headphone mode in addition to the digital interface mode. This can be implemented with an active or passive switching arrangement 680 where the speakers 690, 692, and microphone element 694 can be directly connected to the 4 wire cable of the digital interface and the active circuitry is disconnected from the speaker and microphone. By operation of the switching arrangement 680.

In general, as described in detail above, embodiments of the invention have the following properties, although some of the below properties may be driven by implementation details. It does not require processor intervention to maintain an audio signal on the interface. There is a low EMI signature because there are no single-ended digital lines. The interface uses shared and coordinated Tx/Rx duplex operation, (coordinated), and simultaneous digital audio and general data transport. Bandwidth is greater than 64 Kbps general data throughput capacity during max audio playback. Data transmission is sophisticated, including scalable packet size, high maximum rate, flow control, and is able to be updated through software. The interface includes error detection and error handling, including muting audio and retransmitting general data. It synchronizes fast, <10 ms PHY sync. In general it is a very low overhead protocol. It uses timing recovery from the data transitions, and there are a limited number of consecutive bits that are transmitted without a data transition. It also features an ultra low power idle mode, fixed latency of less than 2 ms, and no tighter than 100 ppm crystal.

The interface finds particular application in mobile devices. The interface 150 of FIGS. 1 and 2 may be effectively used in a modern mobile phone accessory. Digital headphones add functionality beyond the passive audio rendering and microphone interface. Some of the digital headphone functionality that may be provided using the described interface includes: external accessory power by using power for the digital headphone, active Noise Cancellation (ANC), headphone specific DSP tuning, which is available across all software applications, interaction with a headphone-accessory-specific software application running on the mobile device. Further functionality includes application control of the digital headphone, for example EQ select, ANC on/off, ambient mix back, etc. Such a system using digital headphones coupled to the digital interface provide an advanced user interface control on the headphone, which the user may use by pressing control buttons, for example. Further applications include data generation by a sensor for monitoring biometric and environmental parameters, for example heart rate, movement, etc.

The digital interface 150 of FIGS. 1 and 2 generally operate using low power that is lower than 12 Mbps USB. The low current of the interface system is achieved through a variety of approaches. Embodiments use a low protocol overhead. In other words, when there is nothing to communicate for MAC (Media Access Control), the full scale audio frame is only 2392 bits. Compared to the 2304 bits of audio data, the overhead is only 88 bits, or 3.8%. Further, there is no separate clock line. Only data transitions are transmitted. The interface uses low voltage signaling. Low signal swing reduces CVF dynamic current during data transitions on the line. As described above, automatic silence detection operates by skipping sending the audio payload when the amplitude is very low, which saves power. Further, embodiments employ automatic amplitude detection, which allows dynamic scaling option where only the lower order bits are transmitted in order to reduce PHY bandwidth and therefore reduce power. Finally, the audio interface includes a low power search mode in which the device is shutdown with only a passive activity detector working, which reduces the standby current significantly.

Having described and illustrated the principles of the invention with reference to illustrated embodiments, it will be recognized that the illustrated embodiments may be modified in arrangement and detail without departing from such principles, and may be combined in any desired manner. And although the foregoing discussion has focused on particular embodiments, other configurations are contemplated.

In particular, even though expressions such as "according to an embodiment of the invention" or the like are used herein, these phrases are meant to generally reference embodiment possibilities, and are not intended to limit the invention to particular embodiment configurations. As used herein, these terms may reference the same or different embodiments that are combinable into other embodiments.

Consequently, in view of the wide variety of permutations to the embodiments described herein, this detailed description and accompanying material is intended to be illustrative only, and should not be taken as limiting the scope of the invention.

The invention claimed is:

1. An audio and data processing apparatus comprising:

a receiver including a receiver manager implemented to receive a bit stream of audio data, determine a dynamic scaling factor for a block of the audio data, determine a sample width for the audio data in the block, and convert the block of audio data into audio samples; and an audio memory to store the audio samples from the receiver for communication to an audio interface wherein said receiver manager is implemented to read a block header for the block of the audio data and determine the dynamic scaling factor based on the block header and further wherein the dynamic scaling factor indicates a most significant bit of the block of audio data to support omission of identical high order bits from the bit stream.

2. The apparatus of claim 1 wherein the dynamic scaling factor supports automatic amplitude detection of audio data in the block.

3. The apparatus of claim 1 wherein the receiver manager is further to perform a Cyclic Redundancy Check on the block of audio data and clear a bad block flag in the audio memory when the Cyclic Redundancy Check is passed.

4. The apparatus of claim 1 wherein the receiver further includes a physical receiver to receive the bit stream as part of a differential analog signal.

5. The apparatus of claim 4 wherein the physical receiver is further configured to receive a frame start pulse indicating a start of a frame containing the block.

6. The apparatus of claim 5 wherein the physical receiver is further configured to determine a start of a preamble of the frame based on a known preamble pattern.

7. The apparatus of claim 5 wherein the physical receiver is further configured to apply a scrambler to the frame to obtain consecutive values scrambled for transmission by a transmitter.

8. The apparatus of claim 5 wherein the physical receiver is configured further to oversample the bit stream and employ bit transitions in the oversampled bit stream to adjust for clock drift.

9. The apparatus of claim 1 further comprising a transmitter to communicate a toggle sequence to reset coupled devices to an active state.

10. The apparatus of claim 1 wherein said receiver manager is implemented to employ the dynamic scaling factor to determine the sample width for the audio data in the block.

11. The apparatus of claim 10 wherein said receiver manager is implemented to employ the sample width to convert the block of audio data into said audio samples.

12. A method for transmitting digital audio data across a low-power, synchronous interface, comprising:

receiving a bit stream of audio data at a receiver manager;

reading a block header for the block to determine a dynamic scaling factor for a block of the audio data at the receiver manager wherein the dynamic scaling factor indicates a most significant bit of the block of audio data to support omission of identical high order bits from the bit stream;

determining a sample width for the audio data in the block at the receiver manager;

converting the block of audio data into audio samples at the receiver manager; and storing audio samples from the receiver in an audio memory for communication to an audio interface.

13. The method of claim 12 wherein the dynamic scaling factor supports automatic amplitude detection of audio data in the block.

14. The method of claim 12 further comprising performing a Cyclic Redundancy Check on the block of audio data and clearing a bad block flag in the audio memory when the Cyclic Redundancy Check is passed.

15. The method of claim 12 further comprising receiving, at a physical receiver, the bit stream as part of a differential analog signal.

16. The method of claim 12 further comprising receiving a frame start pulse indicating a start of a frame containing the block.

17. The method of claim 16 further comprising determining a start of a preamble of the frame based on a known preamble pattern.

18. The method of claim 16 further comprising applying a scrambler to the frame to obtain consecutive values scrambled for transmission by a transmitter.

19. The method of claim 12 further comprising oversample the bit stream and employing bit transitions in the oversampled bit stream to adjust for clock drift.

20. The method of claim 12 further comprising transmitting a toggle sequence to reset coupled devices to an active state.

21. The method of claim 12 further comprising employing the dynamic scaling factor to determine the sample width for the audio data in the block.

22. The method of claim 21 further comprising employing the sample width to convert the block of audio data into said audio samples.

* * * * *